United States Patent [19]

Haas et al.

[11] 4,148,096

[45] Apr. 3, 1979

[54] LIGHT EMITTER ASSEMBLY

[75] Inventors: Steven L. Haas, Marion; Norman O. Fonteneau; Randall W. Moore, both of Acushnet, all of Mass.

[73] Assignee: Acushnet Company, New Bedford, Mass.

[21] Appl. No.: 832,562

[22] Filed: Sep. 12, 1977

[51] Int. Cl.[2] ..... F21P 1/00

[52] U.S. Cl. ..... 362/252; 362/102; 362/800

[58] Field of Search ..... 362/227, 249, 252, 800, 362/103, 102

[56] References Cited

U.S. PATENT DOCUMENTS 3,790,775 2/1974 Rosenblatt ..... 362/800

*Primary Examiner*—Stephen J. Lechert, Jr.

*Attorney, Agent, or Firm*—Eyre, Mann, Lucas & Just

[57] ABSTRACT

An improved light emitter assembly for use in biomechanical electro-optical systems is disclosed. The device comprises a curved rigid or semi-rigid body to which at least three spaced light emitting diodes are affixed. The body is preferably cylindrical or hemispherical.

13 Claims, 7 Drawing Figures

LIGHT EMITTER ASSEMBLY

The present invention relates to an improved light emitting diode assembly for biomechanical electro-optical sensor systems. The device is particularly advantageous in providing a field of view to an electro-optical sensor despite rather extreme movements of body joints. The device has particular application in sports involving a good deal of movement such as golf.

With the increasing application of science to sports, one of the important areas which has been investigated is the biomechanical action of the person involved in the sport to try to diagnose and analyze those areas where improper movements are being made. Since it is difficult to visually observe all portions of a person at once, especially in an active endeavor, electronic aids are of great use. This is particularly true in a sport such as golf where many different parts of the human body are coordinated to try to achieve the desired result.

One of the systems which has been developed for biomechanical measurement involves an electro-optical detector which senses light signals emitted from devices attached on or near the joints of the golfer. As is known by those skilled in the art, fixation of the joints will necessarily fix the positions of the balance of the golfer. When the electro-optical sensor detects the lights at the joints as the golfer moves through a golf swing, the relative positions of the lights can be plotted, e.g. on a printed display. One commonly available system for use in this particular application is sold by Selective Electronic Co. AB under the trademark Selspot.

While particular electro-optical systems useful in the present invention are well known to those of ordinary skill in the art and are not a part of our invention, a brief description of the Selspot system will be given for the benefit of those not skilled in the art.

The Selspot system employs a photodetector having four electrodes. Light emitting diodes (hereinafter LED's) of the infrared region are used. When the light from the LED's impinges on the photodetector surface, a photocurrent is generated which is divided among the four electrodes. This current can then be used to obtain two signals which show the relative linear position of the LED with respect to two axes. Where a second photodetector is used which is also visible to the LED, it is possible to obtain the three dimensional relative position of the LED.

When one or more LED's are lit simultaneously their cumulative output is sensed by the Selspot system as data from a single channel. The Selspot system can be used to measure up to 30 channels by time division multiplexing. This is accomplished by lighting the LED's sequentially and for only a very short period of time, e.g. 50 microseconds approximately every 3 milliseconds. The receiving part of the system is provided with signal processing circuity which is synchronized to the LED's and, thus, a number of LED's can be watched by a single electro-optical sensor. Where two or more photodetectors are used, the three dimensional position of the LED's can be monitored continusously.

In the biomechanical use of the Selspot system, the LED's are affixed to as many body joints as it is desired to analyze and may also be affixed to related implements such as a golf club. In a golf application it is desirable to measure the knees, shoulders, elbows, hips, ankles and wrists. It is pointed out that the wrists can be located by extrapolation from the position of the club shaft and the positions of the elbows if desired.

The applicants have discovered that while systems such as the Selspot system are useful for measuring the biomechanical movements of a golfer, a frequent problem is that the LED(s) at one or more of the joints may be invisible to one or more of the electro-optical sensors because of the complex motion of the gulf swing and can thus not be properly triangulated for determination of its exact position at all times. Even if somewhat visible, data can be lost if the light available is below the minimum threshold requirements of the system.

One method which the applicants attempted in order to try to overcome the problem was to position a number of LED's on a flexible narrow band spaced at even increments and lit simultaneously. These were affixed to a joint such as the wrist or shoulder of the golfer. The origin of the radius of curvature of the band would thus approximate the joint center and would be determined by triangulation from the data of two sensors during the swing. Tests indicated that computation of the position of the joint centers would be unreliable. Since even a minor misposition of a joint can be important in a golfer's swing, the technique was found to be unsuitable.

The applicants have now discovered that these problems can be overcome by the use of rigid or semi-rigid body which is curved and to which at least three LED's are affixed at spaced intervals. For the purposes of the present invention, the effective radius of curvature of the body to which the LED's are affixed should be from about $\frac{1}{8}$ inch to about 1 inch. Where the curved body is hemispherical, the preferred effective radius of curvature is from about $\frac{1}{4}$ inch to about $\frac{1}{2}$ inch. Where the curved body is cylindrical or hemicylindrical, the preferred effective radius of curvature is from about $\frac{1}{4}$ inch to about $\frac{3}{8}$ inch.

The term "effective radius of curvature" has been used since it is not necessary that the body have a continuous curved surface. Rather, it is only required that the LED's give off light in different directions from each other. This can be accomplished quite successfully by using a multifaceted device rather than a curved device. In this instance, and as will be explained in more detail hereinafter, the effective radius of curvature is determined by curve fitting through the point of intersection of the axis of the light beam with the surface of body to which the LED is attached.

The minimum number of LED's affixed to the curved body in accordance with the present invention is three and they are spaced over an arc of at least about 120° about the axis of symmetry of the body. It is not necessary that the LED's all be in at the same plane and, in fact, it is preferred in the hemispherical embodiment that they be in different planes as discussed hereinafter.

These and other aspects of the present invention may be more fully understood with respect to the drawings wherein.

Figure 1:
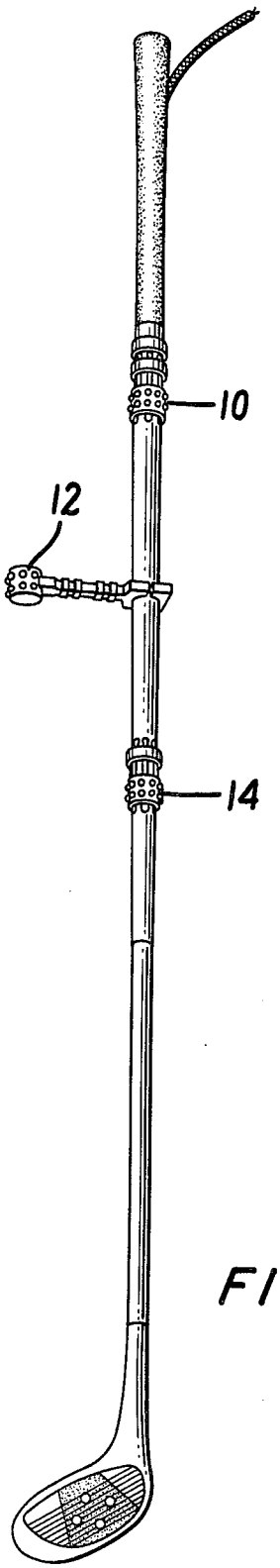
FIG. 1 shows a golf club shaft with three cylindrical bodies having LED's associated therewith.

Where it is desired to affix the LED's to a golf club shaft, it has been found that a cylindrical or hemicylindrical device is suitable and this is shown in FIG. 1. Referring to FIG. 1, there are shown three devices according to the present invention 10, 12 and 14. Each of these is cylindrical and this is the preferred form of construction. Three devices have been used with one spaced from the axis of the shaft so that proper spatial orientation of the golf club can be made. Each of the devices 10 and 14 comprises twelve diodes arranged 360° about the cylinder. Device 12 comprises twelve diodes arranged 270° about the cylinder and utilizes the remaining 90° for mounting to bracket 15. In operation, all diodes on a particular device 10, 12, 14 are operated simultaneously. It will be appreciated that this will give more reliable readings than will a single LED but the use of only one LED at each location is within the contemplation of the present invention.

Figure 2:
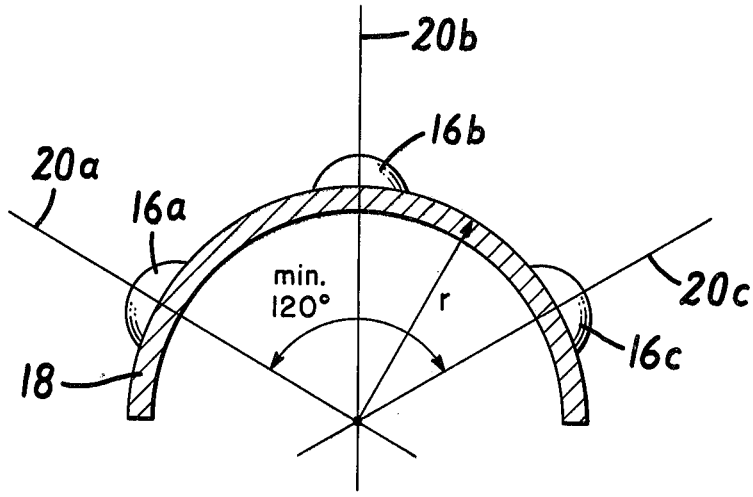
FIG. 2 shows a cross-section of a hemicylindrical apparatus according to the present invention.

Each of the cylindrical bodies of FIG. 1 actually consists of two hemicylinders which are hingedly connected. While it is aesthetically pleasing to use a complete cylinder, in some applications it is possible to use only a hemicylinder. A cross-sectional view from the top of such a device is shown in FIG. 2. In this particular embodiment, only one LED 16 is used at each location. The LED's **16*a*, 16*b* and 16*c* are substantially tangent to the surface of hemicylinder 18 and emit light to the strongest degree along their respective axes 20*a*, 20*b* and 20*c*. The radius of curvature r of the hemicylinder 18 is suitably ¼ to ⅜ inch as discussed hereinbefore. The LED's are spaced along the surface of the hemicylinder 18 through a minimum arc of 120°. In this particular embodiment, the middle LED 16*b* is located approximately midway between the end LED's 16*a* and 16*c***.

Figure 3:
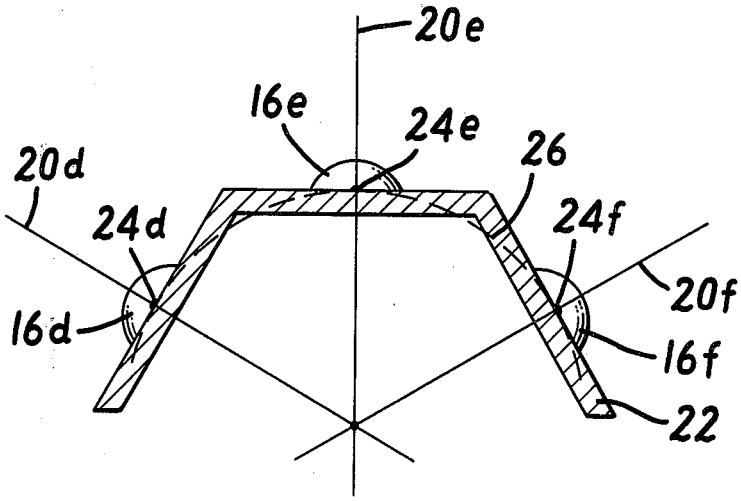
FIG. 3 shows an alternate configuration for the apparatus of FIG. 2.

In FIG. 3 is shown another embodiment of the device of FIG. 2. In this case LED's **16*d*, 16*e* and 16*f* are positioned on a hemihexagon. This resembles a hemicylinder and can be called a hemicylinder-like body (as can a hemicylinder itself). The effective radius of curvature of the hemihexagon is determined by use of the axes 20*d*, 20*e* and 20*f*. Where the axis intersects the surface of the hemihexagon 22 at points 24*d*, 24*e* and 24*f* respectively, a curve 26 can be drawn as shown and the radius of the semicircular curve which best fits these points is the effective radius of the hemihexagon. Again, the LED's are spaced through an arc of at least about 120° with respect to the drawn semicircular curve 26** of the hemihexagon. It will be appreciated that this embodiment of the present invention is not limited to hemicylinders and hemihexagons and could be of other regular shapes such as hemioctagon, hemidecagon, etc., or could be of irregular shape. In fact, excellent results have been obtained using hemioctagons.

While a hemicylinder or equivalent device could also be used on the body of the golfer, it has been found that hemispherical devices or equivalent faceted bodies such as hemipolyhedra are preferred.

Figure 4:
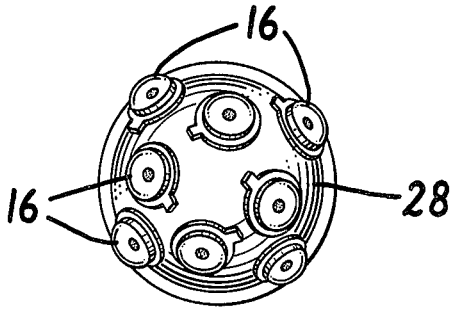
FIG. 4 shows a hemispherical apparatus according to the present invention.

In FIG. 4 is shown a preferred embodiment of such a device. As there shown, there are eight LED's 16 mounted on the surface of a hemisphere 28. Eight LED's are preferred so that a suitable amount of light is visible to the electro-optical sensor. As shown, the diodes are positioned on lesser circles with the diodes spaced at 90° and with the two sets of four diodes offset 45° from each other.

Figure 5:
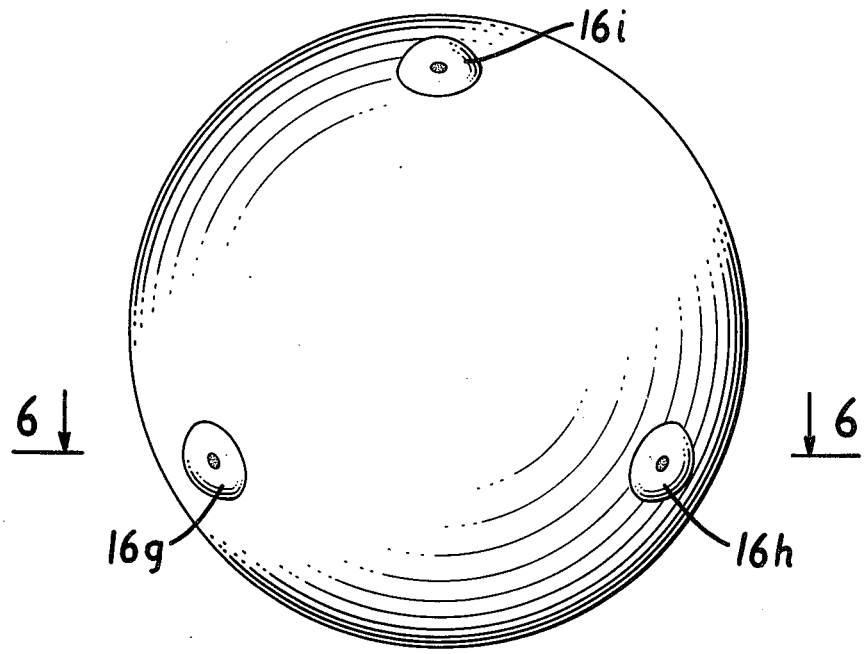
FIG. 5 is a top view of an alternate positioning of the LED's on a hemispherical body.
Figure 6:
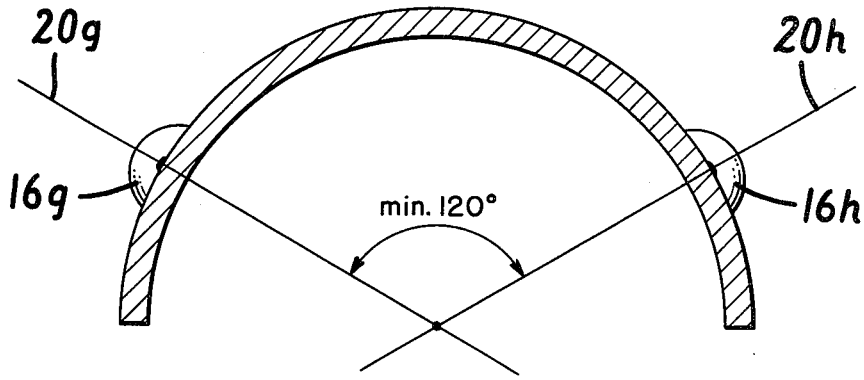
FIG. 6 shows a cross-section through line 6—6 of FIG. 5.

While eight LED's are preferred on the hemispherical or equivalent structure, as few as three can be used. In FIGS. 5 and 6 is shown the preferred spacing where three LED's are used. Referring to FIG. 6 which is a sectional view of FIG. 5 along line 6—6 there are shown LED's **16*g* and 16*h* which have axes 20*g* and 20*h* respectively. In accordance with the present invention, the minimum arc between the axes is 120°. In this preferred embodiment, the same angular relationship of the axes exists between LED's 16*g*-16*h*, 16*g*-16*i* and 16*h*-16*i***.

As an alternate to the hemispherical structure can be used a hemipolyhedron. As is well known, a polyhedron is a body with faces formed from plane polygons. Since there are only five regular polyhedra (tetrahedron, hexahedron, octahedron, dodecahedron, and icosahedron), such a body will usually be an irregular hemipolyhedron. However, any of the regular polyhedra except the tetrahedron are suitable for the hemipolyhedron to be used in the present invention.

The particular LED's for use in this invention are not unique to the applicant but are rather commercially available. The applicants have found that galium arsenide crystal semi-conductors having a radiant power output between three and eight milliwatts are quite suitable for use in the present invention.

Figure 7:
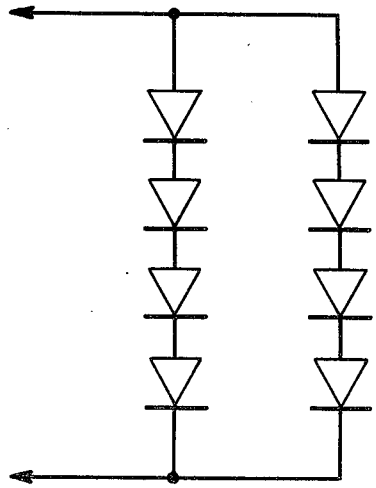
FIG. 7 shows a typical wiring scheme where eight LED's are employed.

As with the LED's themselves, the particular hook-up of the LED's is not our invention and any suitable wiring scheme can be employed. FIG. 7 shows a schematic of a typical hook-up where eight of the LED's as described hereinbefore are used in the Selspot system.

While the particular hook-up is not our invention, we have discovered that the wire used for the hook-up can advantageously be used as a hinge to connect two hemicylindrical members whereby a completed cylinder is obtained which can be easily attached to and detached from a golf shaft.

It will be understood that the claims are intended to cover all changes and modifications of the preferred embodiments of the invention, herein chosen for the purpose of illustration which do not constitute departures from the spirit and scope of the invention.

What is claimed is:

1. An apparatus for the generation of light in biomechanical electro-optical systems, said apparatus comprising at least three light emitting diodes affixed to the surface of a curved body, said light emitting diodes emitting light substantially only in the infrared region, said body having an effective radius of curvature of from about ⅛ inch to about 1 inch, said light emitting diodes being spaced on said curved surface, and at least two of said light emitting diodes being angularly spaced by at least about 120° on said curved surface.

2. The apparatus of claim 1 wherein said curved body is a hemicylinder-like body and has an effective radius of curvature of from about ¼ inch to about ⅜ inch.

3. The apparatus of claim 2 wherein there are at least six light emitting diodes on the surface of the hemicylinder-like body.

4. The apparatus of claim 2 wherein the hemicylinder-like body is a hemicylinder.

5. The apparatus of claim 2 wherein the hemicylinder-like body is a hemioctagon.

6. The apparatus of claim 1 wherein said curved body is a cylinder-like body and has an effective radius of curvature of from about ¼ inch to about ⅜ inch.

7. The apparatus of claim 6 wherein there are at least twelve light emitting diodes on the surface of the cylinder-like body.

8. The apparatus of claim 6 wherein the cylinder-like body is a cylinder.

9. The apparatus of claim 6 wherein the cylinder-like body is an octagon.

10. The apparatus of claim 1 wherein said curved body is a hemisphere-like body and has an effective radius of curvature of from about ¼ inch to about ½ inch.

11. The apparatus of claim 10 wherein there are at least eight light emitting diodes on the surface of the hemisphere-like body.

12. The apparatus of claim 10 wherein the hemisphere-like body is a hemisphere.

13. The apparatus of claim 10 wherein the hemisphere-like body is a hemipolyhedron.

* * * * *